US006181254B1

(12) United States Patent
Vogele

(10) Patent No.: US 6,181,254 B1
(45) **Date of Patent: *Jan. 30, 2001**

(54) REMOTE KEYLESS ENTRY SYSTEM HAVING PASSIVE TRANSMISSION MODE

(75) Inventor: Allan W. Vogele, Brecksville, OH (US)

(73) Assignee: TRW Inc., Lyndhurst, OH (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/658,934

(22) Filed: May 31, 1996

(51) Int. Cl.[7] ..... G08C 19/00

(52) U.S. Cl. ..... 340/825.69; 340/825.31; 455/92; 307/10.1

(58) Field of Search ..... 340/825.69, 825.72, 340/825.31, 825.04, 542; 307/10.1, 10.3; 455/92

(56) References Cited

U.S. PATENT DOCUMENTS 4,385,204 * 5/1983 Wine ..... 179/1
4,663,626 * 5/1987 Smith ..... 340/825.69
4,881,148 11/1989 Lambropoulos et al. .
4,942,393 7/1990 Waraksa et al. .
5,379,033 1/1995 Fujii et al. .
5,412,377 * 5/1995 Evans et al. ..... 340/825.22
5,517,187 * 5/1996 Bruwer et al. ..... 340/825.3
5,942,985 * 8/1999 Chin ..... 340/825.31

* cited by examiner

*Primary Examiner*—Michael Horabik
*Assistant Examiner*—Anthony A. Asongwed
(74) *Attorney, Agent, or Firm*—Tarolli, Sundheim, Covell, Tummino & Szabo L.L.P.

(57) ABSTRACT

A keyless vehicle entry system is presented for controlling a vehicle device function, such as the locking-unlocking operations of a vehicle door lock. The system includes a portable transmitter and a receiver that responds to a vehicle function request signal transmitted by the transmitter for controlling performance of a vehicle function. The transmitter includes a vehicle function request switch and a controller. The controller has a normal mode of operation during which it is responsive to closure of the switch for operating the transmitter to transmit a vehicle function request signal. The controller has a passive mode of operation in response to closure of the switch for more than a given period of time. During this passive mode of operation, the controller operates the transmitter to automatically and repeatedly transmit the vehicle function request signal.

14 Claims, 5 Drawing Sheets

REMOTE KEYLESS ENTRY SYSTEM HAVING PASSIVE TRANSMISSION MODE

THE FIELD OF THE INVENTION

The present invention relates to the art of remote keyless vehicle entry systems and, more particularly, to such a system wherein a portable remote transmitter has a normal mode of operation for transmitting a vehicle function request signal in response to actuation of a vehicle function request switch and a passive mode of operation during which the transmitter automatically and repeatedly transmits the vehicle function request signal.

DESCRIPTION OF THE PRIOR ART

Remote keyless entry (RKE) systems are known in the art for controlling the locking and unlocking functions of a motor vehicle door lock. Such systems include a receiver mounted in a motor vehicle and a portable hand held transmitter located remote from the receiver. The receiver has a memory that stores one or more security codes, each of which identifies a transmitter that is authorized entry into the vehicle. Each transmitter is provided with a plurality of manually actuatable switches, each representative of a vehicle control function to be performed, such as the unlocking or locking of the vehicle door or the unlocking of the vehicle trunk lid. The transmitter includes circuitry that responds to the actuation of one of the switches to transmit a digital signal that includes a security code that uniquely distinguishes the transmitter from a plurality of similar transmitters and a function code representative of the control function to be performed, such as the unlocking of a door. When the receiver receives such a digital signal, it compares the received security code with each stored security code to determine whether the security code was transmitted by an authorized transmitter. If a match takes place, the receiver responds to the function code by causing performance of the control function requested, as by unlocking a vehicle door. A system described above is disclosed in the U.S. Patent to Lambropoulos, et al. U.S. Pat. No. 4,881,148, the disclosure which is herein incorporated by reference.

A passive RKE system is one in which the operator need not push a switch button on the remote transmitter in order to transmit a coded signal to a vehicle receiver and thereby unlock a vehicle door or the like. Instead, such a system employs a transmitter that periodically transmits a coded signal which is received by the vehicle receiver to cause a performance of a vehicle function, such as opening a vehicle door. The function takes place once the transmitter is within the operating range of the vehicle receiver. Also, in such a passive system, the vehicle doors may be automatically locked as the operator leaves the operating range of the vehicle receiver. Such a passive RKE system may be of great convenience to an operator such as when the operator is unable to operate the transmitter switch button when carrying a load of groceries. Such a passive RKE system does require that the transmitter periodically transmit a vehicle function request signal so that the vehicle receiver knows when the transmitter has approached to within the operating range of the vehicle receiver. The transmissions consume power leading to rapid discharge of batteries contained in the transmitter housing. To reduce power consumption, the transmitter includes a motion detector and provides the periodic transmissions only when the transmitter is being jostled about. Such a system is disclosed in the U.S. Patent to Waraksa, et al. U.S. Pat. No. 4,942,393.

The U.S. Patent to Fujii, et al. U.S. Pat. No. 5,379,033 discloses a RKE system wherein the transmitter carries two buttons A and B each for causing transmission of a request signal for the same vehicle function, i.e., such as UNLOCK DOORS. If the operator depresses switch button A, the vehicle function request signal is transmitted periodically over a certain period of time. When switch button B is depressed, the vehicle function request signal is transmitted only once. Unfortunately, switch button B takes up valuable space on the transmitter housing, reducing the amount of space available for buttons for other functions and increasing the complexity of the transmitter switch array.

SUMMARY OF THE INVENTION

In accordance with the present invention, a portable transmitter is provided for use in a remote keyless entry system having a vehicle receiver responsive to a vehicle function request signal transmitted by the transmitter for controlling performance of a vehicle function. The transmitter includes a vehicle function request switch and a controller having a normal mode of operation during which it is responsive to closure of the switch for operating the transmitter for transmitting the vehicle function request signal. The controller has a passive mode of operation in response to closure of the same switch for more than a given period of time and during which passive mode the controller operates the transmitter to automatically and repeatedly transmit the vehicle function request signal.

BRIEF DESCRIPTION OF THE DRAWINGS

The foregoing and other objects of the invention will become more readily apparent from the following description of the preferred embodiment of the invention as taken in conjunction with the accompanying drawings which are a part hereof and wherein.

DESCRIPTION OF PREFERRED EMBODIMENTS

Figure 1:
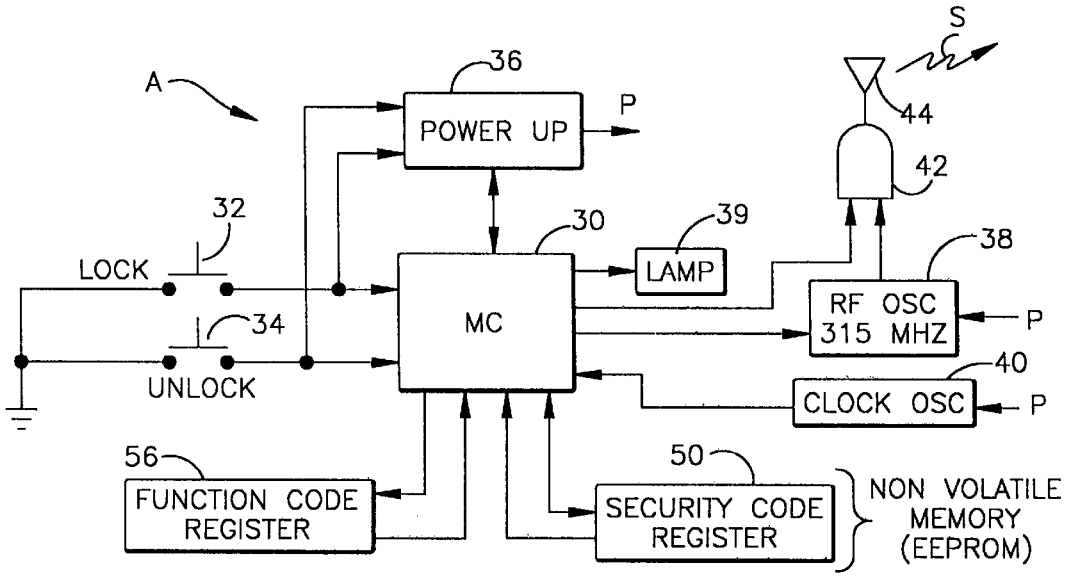
FIG. 1 is a schematic-block diagram illustration of a portable transmitter constructed in accordance with the present invention.
Figure 2:
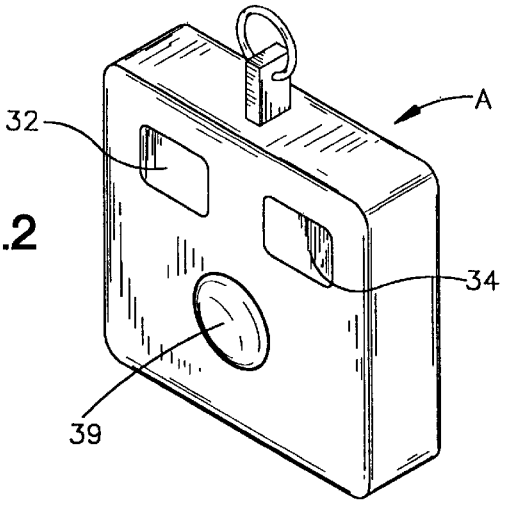
FIG. 2 is a perspective view of the transmitter housing or fob employed as a key holder.

Reference is now made to the drawings wherein the showings are for purposes of illustrating a preferred embodiment of the invention only, and not for the purpose of limiting same. The keyless entry system described herein may include one or more remote, portable transmitters which communicate with a vehicle receiver to achieve remote control of the vehicle's door lock and unlock mechanism as well as other vehicle device functions to be described in greater detail hereinafter. The portable transmitters may include two similar transmitters A and B (only the circuitry of transmitter A will be described herein in detail, however). Each transmitter takes the form illustrated with respect to transmitter A in FIGS. 1 and 2. The circuitry employed is shown in FIG. 1 and the transmitter housing or fob is illustrated in FIG. 2. A miniature battery is carried within the fob for providing operating power.

Figure 4:
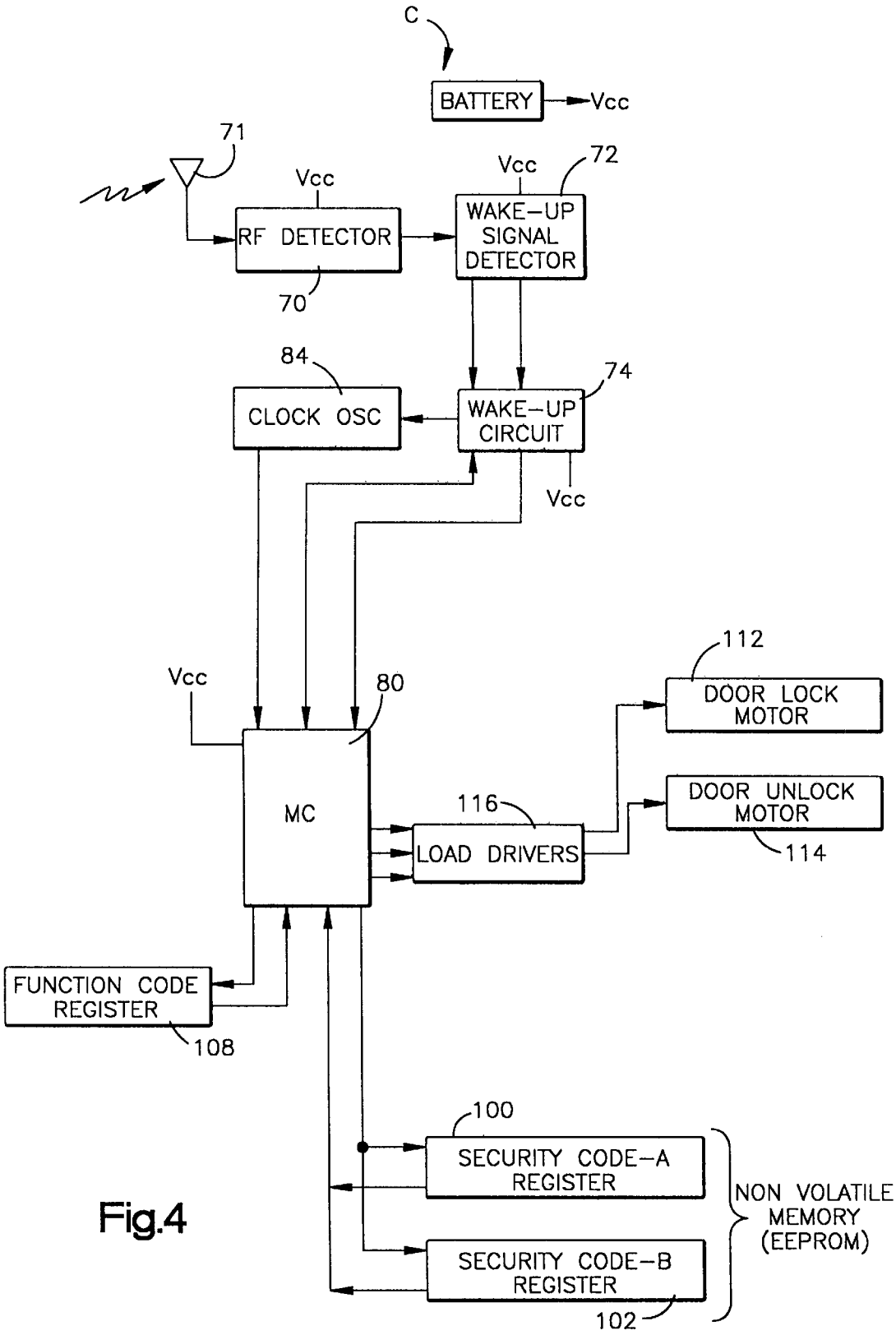
FIG. 4 is a schematic-block diagram illustration of a vehicle receiver employed in the present invention.

Each remote transmitter A and B is assigned a security code unique to the particular transmitter. Each vehicle receiver C, see FIG. 4, is mounted on a vehicle and will permit entry into the vehicle of an operator carrying a transmitter that is coded with a proper security code. In the example being given, transmitters A and B are provided with proper security codes SC-A and SC-B, respectfully, which will permit entry into the vehicle in which is mounted receiver C. As will be brought out hereinafter, the receiver normally serves to receive from a portable transmitter, such as transmitter A or B a signal including a security code that uniquely identifies the transmitter, together with a function code requesting a particular vehicle device operation, such as unlocking of the vehicle doors. The vehicle receiver includes a memory that stores one or more security codes, each of which uniquely identifies a transmitter that is authorized entry into the vehicle. If the received signal includes a security code that matches the stored security code then the receiver initiates action to perform the commanded vehicle operation, such as a vehicle door unlock function.

Having briefly described a remote keyless entry system, attention is now directed to a more detailed description of a portable transmitter as well as a vehicle mounted receiver constructed in accordance with the present invention.

Portable Transmitter

Each portable transmitter may take the form of transmitter A illustrated in FIG. 1. Transmitter A includes a microcomputer 30 having appropriate internal ROMs, EEPROMs and RAMs programmed to perform the functions of the system, as herein described, and having sufficient I/O terminals for interconnection with input and output peripherals. For reasons that will be clearer hereafter, the microcomputer 30 also contains three timers operable to time selected intervals under software control. The transmitter A also includes a pair of manually operable pushbutton switches 32 and 34. Upon pressing one of these pushbutton switches 32 and 34, a power up circuit 36 is actuated to direct power P to the microcomputer 30 and to oscillators 38 and 40.

The oscillator 38 has a nominal frequency of 315 MHz. Oscillator 40 is a typical clock oscillator of the type used to provide clock signals to microcomputers. The output of oscillator 40 is used to time the function of microcomputer 30 and thus to control the binary signals transmitted by the antenna 44 under control of an AND gate 42. One input to this AND gate 42 is taken from the microcomputer 30 and the second is taken from the oscillator 38. The output is the 315 MHz carrier, gated ON and OFF by the binary signal supplied by microcomputer 30. This forms the amplitude modulated transmitted signal S. The code in signal S is binary with a logic 1 and a logic 0 being distinguished from each other by a difference in length or duration.

The microcomputer 30 of the transmitter A includes several internal memories sometimes referred to as registers. Whereas these registers are internal of the microcomputer, some registers are illustrated in FIG. 2 to assist in the description herein. These include a security code register 50 and a function code register 56. Register 50 is preferably located in EEPROM memory, and register 56 is located in RAM.

The security code register 50 contains a code which uniquely identifies the transmitter A and thus distinguishes it from other, similar transmitters. The security code register 50 in transmitter A stores a security code that is fixed in the transmitter at the time of the manufacturer and this may be accomplished in the manner described in U.S. Pat. No. 4,881,148. The security code may, for example, take the form of four eight bit bytes.

The function code register 56 stores the function code to be transmitted as part of the transmitted signal from the transmitter A to the vehicle mounted receiver C. The function code preferably takes the form of an eight bit, coded byte with the bits being arranged to represent the function being requested, such as "unlock the vehicle door" or "lock the vehicle door".

The signal transmitted by the transmitter A has a range on the order of fifty feet. The transmitted signal includes a start portion 60 that may include four bits, a security portion 62 that includes four, eight bit bytes and a function code portion 64 that includes eight bits. This may be followed by a checksum code, as is common in the art.

Vehicle Receiver

Figure 3:
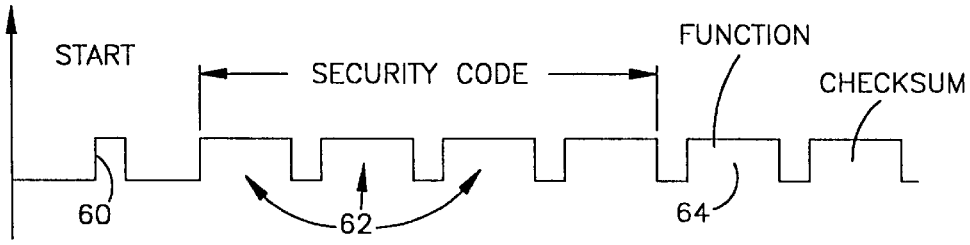
FIG. 3 is an illustration of a waveform showing a transmitted request signal.

The vehicle receiver C (FIG. 4) includes an RF detector 70 tuned to the transmitter signal frequency of 315 MHz. As the signal S is received at the receiver's antenna 71, the detector 70 recognizes the frequency of the signal and allows the first portion 60 (FIG. 3) to pass to a wake up signal detector 72. Detector 72 checks to see if the BAUD rate is proper. If the BAUD rate is proper, detector 72 activates a wake up circuit 74. Circuit 74 responds by supplying operating voltage $V_{cc}$, such as 5.0 volts, to the receiver's microcomputer 80.

The data in the received signal is supplied to the microcomputer 80 from detector 70 through the intermediate circuits 72 and 74. The data is clocked into microcomputer 80 by clock pulses obtained from a clock oscillator 84. Microcomputer 80, as in the case of microcomputer 30 in the transmitter A, includes a plurality of internal memories including ROMs, RAMs and EEPROMs. The internal ROM is loaded at the time of manufacture (e.g., mask programmed) with a program which causes microcomputer 80 to perform the functions to be described in greater detail hereinafter.

Some of the internal memories, or registers of the microcomputer 80 are illustrated in FIG. 4 to assist in the description of the invention. These include registers 100 and 102 which preferably take the form of electrically programmable nonvolatile memory (EEPROM). Register 100 stores a security code SC-A which uniquely identifies transmitter A from which the vehicle receiver C may validly receive a digital command signal. The code set into register 100 may be placed in the memory at the factory or may be programmed in the field in the manner as described in U.S. Pat. No. 4,881,148. As it may be desirable for vehicle receiver C to validly receive digital signals from more than one portable transmitter, a second security code register 102 is provided, identical to register 100, but which includes a security code SC-B corresponding to the code stored in the security code register of transmitter B (not shown).

The receiver C also includes a function code register 108. This is a temporary memory and serves to receive and temporarily store the function code portion of the digital signal received from a portable transmitter, such as transmitter A. If the receiver C properly receives a valid security code from the transmitter A, it will decode the function code stored in register 108 and perform the requested function, such as locking or unlocking a vehicle door by way of suitable door lock and unlock motors driven under the control of the microcomputer 80.

As shown in FIGS. 1 and 2, the transmitter housing or fob carries a pair of manually actuatable pushbutton switches 32 and 34. Each pushbutton switch is for a specific vehicle device function such as LOCK or UNLOCK. As shown, pushbutton switch 32 controls the LOCK vehicle device function. Pushbutton switch 34 controls the UNLOCK vehicle device function. Thus, when a coded request signal is transmitted by the transmitter in response to actuation of pushbutton switch 32, the function code 64 portion of the request signal includes a coded LOCK command requesting that the vehicle door locks be locked. Similarly, when such a coded request signal is transmitted in response to actuation of the UNLOCK pushbutton switch 34, the function code 64 includes an UNLOCK command.

In accordance with the present invention, the microcomputer 30 in the transmitter is programmed so that when the vehicle device function pushbutton switch 34 is held down by an operator for a time period exceeding a predetermined period, such as five seconds, the transmitter will then operate in a passive mode for a given duration, such as five minutes. During the passive mode, the transmitter will automatically and repeatedly transmit, at two second intervals, a vehicle function request signal including an UNLOCK command requesting that the vehicle doors be UNLOCKED. After five minutes, the transmitter will return to its normal mode of operation, thereby ceasing the automatic periodic transmissions. For the duration of such a passive mode of operation, a visual indicator in the form of lamp 39 will be controlled by the microcomputer 30 to flash ON and OFF to indicate that the transmitter is in the passive mode of operation.

Reference is now made to FIGS. 5 through 9 which illustrate flow charts showing the manner in which the microcomputer 30 in the transmitter A of FIG. 1 is programmed in accordance with the present invention. The software which will now be described makes use of three internal timers. The three timers include:

BUTTON TIMER: The button timer is used to measure the length of time that pushbutton 34 has been held down by the operator. If the time exceeds five seconds, the "passive mode" of operation will be initiated.

PASSIVE MODE TIMER: The passive mode timer is used to measure a five minute length of time, representing the duration of the passive mode of operation. During the five minutes measured by the passive mode timer, the transmitter will broadcast the unlock command every two seconds.

DWELL TIMER: The dwell timer is used to measure the interval or "dwell time" (two seconds, in the embodiment being described) between successive transmissions in the passive mode. Each time a passive mode transmission is made, the dwell timer is turned on to delay the next transmission until two seconds have elapsed since the previous transmission.

Initially, the transmitter is in a power-down standby condition awaiting closure of a vehicle function request switch. The operation commences with a START condition in step 300, initiated by closure of one of the pushbutton switches 32 or 34. In response to actuation of the switch, the program advances to a passive (Px) mode check routine at step 302 and as described in greater detail below with reference to FIG. 6. Thereafter, in step 304, a routine for checking other pushbutton switch actuations is entered as will be described in conjunction with FIG. 8. In step 306, a determination is made as to whether the passive (Px) mode of operation is still in effect. If so, the procedure returns to step 302. Otherwise, the procedure advances to a sleep stage in step 308, awaiting actuation of a pushbutton switch on the transmitter.

Figure 6:
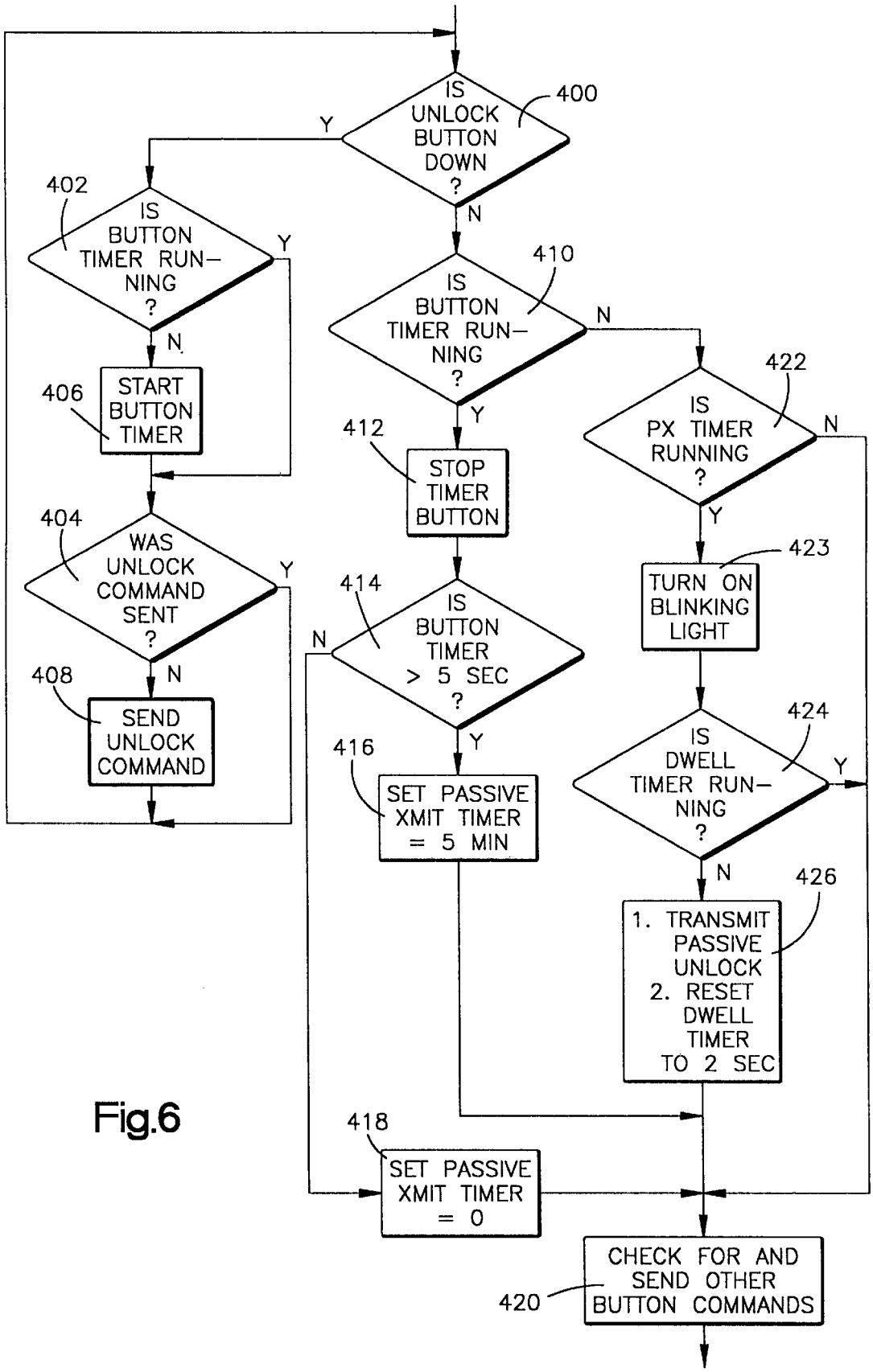

FIG. 6 shows the passive (Px) mode check routine 302. In step 400, a determination is made as to whether the UNLOCK pushbutton switch 34 is closed. If it is closed, then in step 402 a check is made as to whether the button timer is running. As stated above, this timer is used to measure how long a pushbutton switch is held down or closed.

If the button timer is running, a determination is made in step 404 as to whether the transmitter has transmitted a vehicle function request signal including an UNLOCK command. If the button timer is not running, then in step 406, the button timer commences timing the duration that the button is held down and the procedure advances to step 404.

If, in step 404, a determination is made that the vehicle function request signal including an UNLOCK command has been sent, then the procedure returns to step 400 to determine whether the UNLOCK switch button is still down. If, in step 404, a determination was made that the vehicle function request signal having an UNLOCK command was not sent, then, in step 408, such a request signal is transmitted and the routine returns to step 400.

If, in step 400, a determination was made that the UNLOCK pushbutton switch 34 is not then in a closed position, then the procedure advances to step 410. In step 410, a determination is made as to whether the button timer is running. If it is, then in step 412, the timer is stopped in order to determine the time duration that the UNLOCK button switch 34 was held down.

In step 414, a determination is made as to whether the pushbutton has been down for more than five seconds. If so, then in step 416, the passive mode timer is set to time a duration of five minutes. This timer will control the period of time that the transmitter is in the passive (Px) mode of operation. If the determination in step 414 is that the time is less than five seconds then program flow jumps to step 418. In step 418, the passive mode timer is set to zero, thus discontinuing the passive mode of operation if it is then running.

Figure 5:
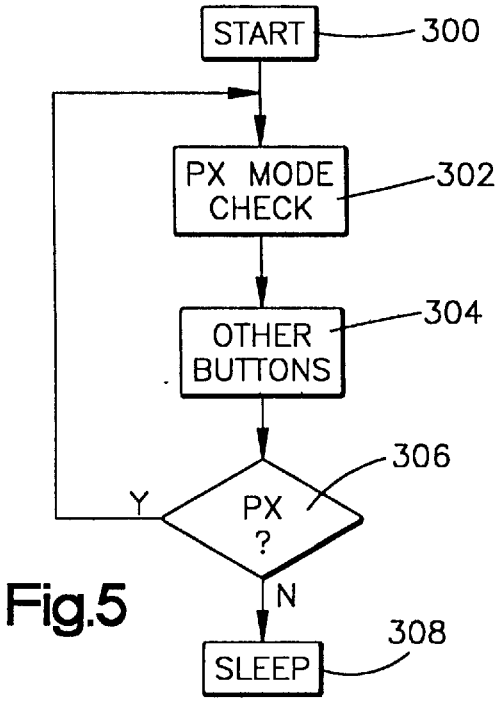
FIGS. 5–9 are flow diagrams illustrating the operation of the transmitter herein; and, FIGS. 10–12 are flow diagrams illustrating the operation of the receiver herein.

Upon termination of step 416 or step 418, the procedure advances to step 420, which corresponds with step 304 in FIG. 5. In this step, a check is made to determine whether any other switch buttons have been actuated. If so, the transmitter will transmit an appropriate command. For example, the LOCK button switch 32 may be actuated and the routine, with reference to FIG. 8, will be entered into.

If, in step 410, a determination is made that the button timer is not running, then the procedure advances to step 422 during which a determination is made as to whether or not the passive mode timer is running. If it is, then, in step 424, a determination is made as to whether the dwell timer is running. As indicated previously, this timer is used to establish the time interval between successive transmissions when the transmitter is in the passive mode. If the dwell timer is not running during the passive mode of operation, as timed by the passive mode timer, then it is time to transmit the UNLOCK command (along with a security code). Following the transmission, the dwell timer is reset so that it will begin another dwell period. Each dwell period may last, for example, two seconds. Thereafter, the procedure advances to step 420.

This operation of transmitting the UNLOCK command followed by a dwell period will be repeated for the duration of passive mode of operation.

Figure 7:
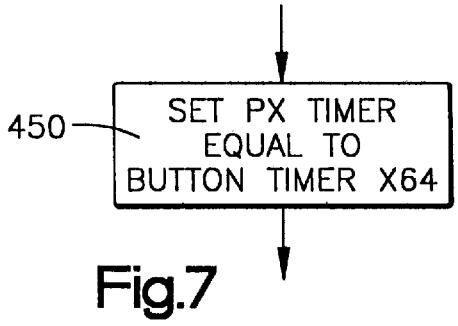

Reference is now made to FIG. 7 which presents an alternative step 450 to be substituted, if desired, for step 416 in FIG. 6. Thus, in step 450, the passive mode timer is set to time-out a period equal to the time noted by the button timer in step 412 times 64. The number 64 is chosen for simplicity of design in digital circuitry. Consequently, if the total time noted by the button timer is six seconds, then the passive mode timer will be set to 384 seconds, which is slightly more than six minutes.

Figure 8:
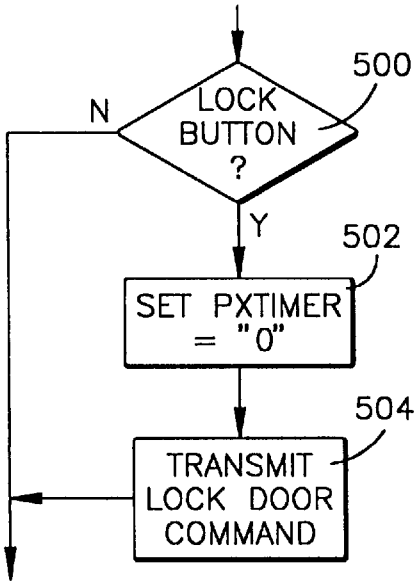

Reference is now made to FIG. 8 which illustrates a routine incorporated in the other button routine in step 304 of FIG. 5. In this routine, after the passive mode check is completed, a determination is made in step 500 as to whether or not the LOCK pushbutton switch 32 has been closed. If so, then in step 502, the passive timer is set to zero. In step 504, the transmitter transmits the LOCK door command (along with a security code). This routine serves to take the transmitter out of the passive mode of operation if the LOCK pushbutton switch 32 is closed.

The transmitter as described and shown thus far may be used with a conventional receiver of the type shown in U.S. Pat. No. 4,881,148. The receiver will operate to unlock the doors, whether commanded via signals transmitted in the normal or passive mode.

Figure 9:
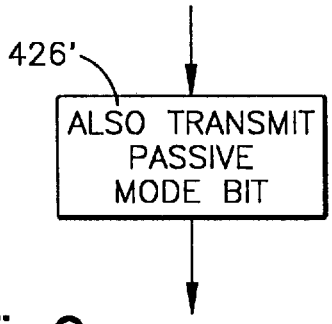

Reference is now made to FIG. 9 that illustrates an alternative step 426' for step 426 in the transmitter routine presented in FIG. 6. Step 426' includes all of step 426 but also includes the transmission of a passive mode bit when transmitting the UNLOCK signal to signify to the receiver that the message is being sent in the passive mode. This is accomplished by using one bit position in the function code portion 64 as a "passive mode" bit. If the bit is high, this signifies that the message is being transmitted in the passive mode. The receiver will recognize this code and change the manner in which it responds to the message as opposed to the manner in which it responds in the normal mode of operation. This will be described hereinbelow with reference to FIGS. 10–12.

Figure 10:
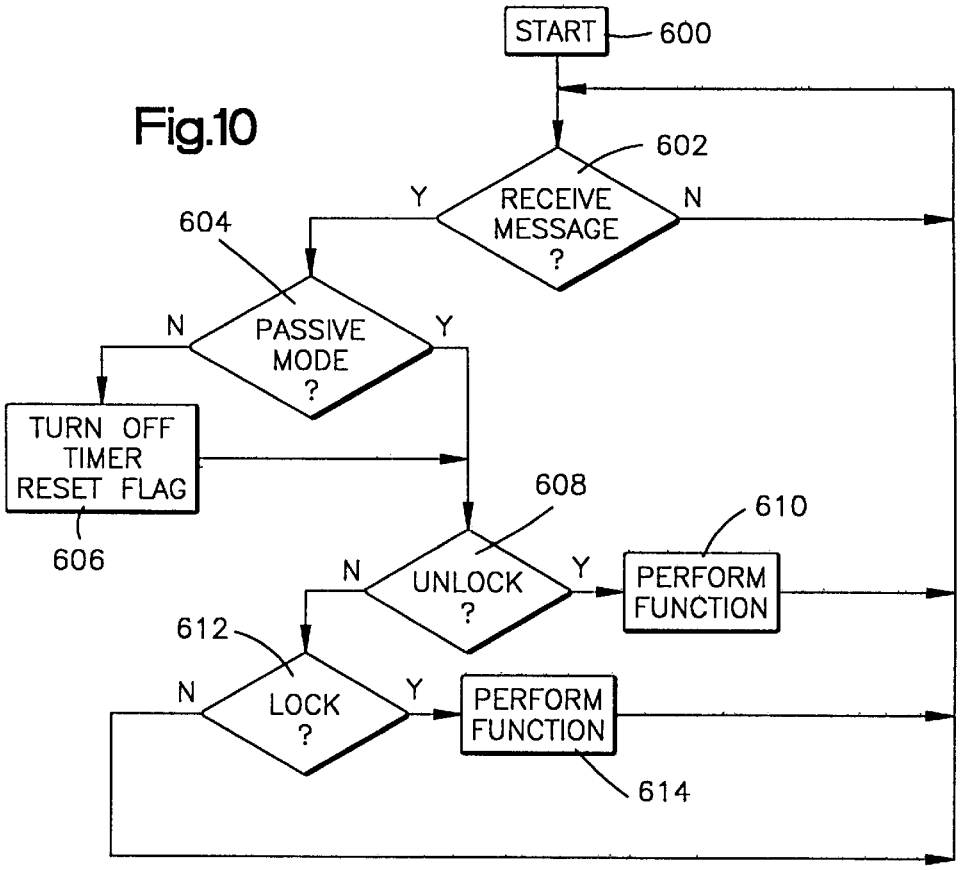
Figure 11:
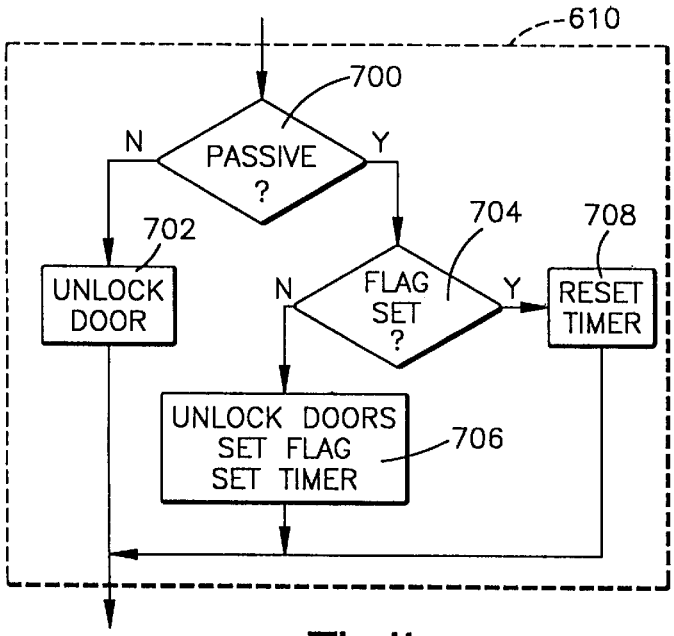
Figure 12:
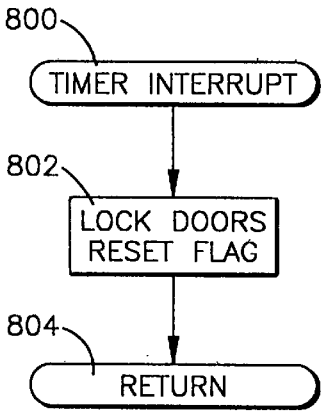

FIGS. 10–12 illustrate the program operation of a receiver constructed as shown in U.S. Pat. No. 4,881,148, but reprogrammed to take advantage of the additional information available through the addition of a "passive mode" bit to the transmitted signal. A receiver programmed as illustrated in these figures will (a) unlock the doors only once in each "passive mode", and (b) lock the doors automatically after a preset interval.

The operation commences with a START condition in step 600 wherein normal initialization of the system takes place. In step 602, a determination is made as to whether a message has been received from the transmitter. If not, the routine recycles to continue this determination. If a message has been received, the routine advances to step 604 where a determination is made as to whether the "passive mode" bit of the received message is high. If not, then (a) a timer for timing a preset interval is turned OFF and (b) a "passive mode" flag is reset to thereby indicate that the message was normal, rather than "passive mode." If the "passive mode" bit of the received message is high, however, the procedure advances to step 608, at which a determination is made as to whether the message includes an UNLOCK command. If it does, the procedure advances to step 610 at which the UNLOCK function is performed.

Attention is now directed to FIG. 11 which illustrates in greater detail the steps performed in the routine 610 of FIG. 10. In this routine a determination is again made as to whether the received message is a "normal" or "passive mode" message. If the message is a "normal" message, then the door is UNLOCKED at step 702. If the received message is a "passive mode" message, however, then the procedure advances to step 704 to determine whether or not the internal "passive mode" flag has already been set. The purpose of the flag is to indicate to the remainder of the software that a "passive mode" of operation has been engaged. Once the "passive mode" flag has been set, it will remain set until either (a) it is reset in step 606 due to receipt of a normal or active mode message, or (b) it is reset in step 802 (described below) as a result of time-out of the one minute timer. If the flag has not already been set, then the commanded function of UNLOCKING the doors is performed, the flag is set and a timer is started to time the preset interval, such as one minute.

If, in step 704 (FIG. 11), a determination was made that the flag is set, then the timer is reset at step 708. As a result of step 708, the timer will be reset each time a new "passive mode" command is received. Since "passive mode" commands occur every two seconds and the timer will not time-out until one minute after being reset, it follows that the timer will not time-out as long as "passive mode" commands continue to be received. Once "passive mode" commands stop, however, (i.e., once the transmitter either is taken away or stops transmitting the periodic passive mode commands), the timer will time-out and the receiver will thus automatically emerge from "passive mode" operation.

The timer is internal to the microcomputer in the receiver and thus not shown in the drawings. The timer is configured such that an interrupt signal is generated when the timer times out the pre-established (in this case, one minute) interval. The interrupt signal forces the microcomputer to suspend its normal operations and instead to perform an interrupt servicing routine, shown here in FIG. 12. The interrupt routine commences at step 800. During this routine, the doors are LOCKED and the "passive mode" flag is reset indicating that the system has returned to the "active mode". In return step 804, the microcomputer returns to the FIG. 10 and 11 program at the point of interruption.

Reference is again made to FIG. 10. If, in step 608, a determination was made that the message did not include an UNLOCK command, the procedure advances to step 612. At step 612, a determination is made as to whether the message includes a LOCK command. If so, then the procedure advances to step 614 at which the function required by this command is performed. If, in step 612, it was determined that the message did not include a LOCK command, the procedure returns to wait for the reception of a message from the transmitter.

From the description of the invention, those skilled in the art will perceive improvements, changes and modifications. Such improvements, changes and modifications within the skill of the art are intended to be covered by the appended claims.

Having described the invention, we claim the following:

1. A portable remote transmitter for use in a remote keyless entry system having a vehicle receiver responsive to a digitally coded vehicle function request signal transmitted by a said remote transmitter located remote from said vehicle receiver for controlling performance of a vehicle function, said transmitter comprising:

a manually operable vehicle function request switch for requesting a specific vehicle function;

a controller having a normal mode of operation during which it is responsive to closure of said switch for a time period less than a given period of time for operating said transmitter to transmit a said vehicle function request signal a single time, said controller having a passive mode of operation in response to closure of the same said switch for more than said given period of time and during which passive mode of operation the controller operates said transmitter to automatically and repeatedly transmit the same identical said vehicle function request signal a plurality of times;

means for controlling the time duration of said passive mode of operation; and means for transmitting a said vehicle function request signal containing a passive code having information representing whether or not the said vehicle function request signal is being transmitted during said passive mode of operation.

2. A transmitter as set forth in claim 1 in combination with a vehicle receiver responsive to said vehicle function request signal for controlling performance of said vehicle function, said receiver including means for controlling performance of a said vehicle function in a specific manner when said vehicle function request signal includes a said passive code having information indicating that the said vehicle function request signal is being transmitted during said passive mode of operation.

3. A transmitter as set forth in claim 2 including a portable housing for said transmitter and wherein said housing carries said vehicle function request switch.

4. A transmitter as set forth in claim 3 wherein said housing carries a visual indicator for providing information respecting which mode of operation is in effect.

5. A transmitter as set forth in claim 4 wherein said visual indicator is controlled by said controller to provide a light emitting indication as to which mode of operation is in effect.

6. A transmitter as set forth in claim 5 wherein said visual indicator is controlled by said controller so as to be alternately ON and OFF during said passive mode of operation.

7. A transmitter as set forth in claim 2 including means for automatically initiating locking the vehicle's doors when said passive mode of operation terminates.

8. A transmitter as set forth in claim 2 including means for automatically initiating locking the vehicle's doors a predetermined interval after receiving a said passive mode code.

9. A portable remote transmitter for use in a system having a device receiver responsive to a digitally coded device function request signal transmitted by a said remote transmitter located remote from said device receiver for controlling performance of a device function, said transmitter comprising:

a manually operable device function request switch for requesting a specific device function;

a controller having a normal mode of operation during which it is responsive to closure of said switch for a time period less than a given period of time for operating said transmitter to transmit a said device function request signal a single time, said controller having a passive mode of operation in response to closure of the same said switch for more than said given period of time and during which passive mode of operation the controller operates said transmitter to automatically and repeatedly transmit the same identical said device function request signal a plurality of times;

means for controlling the time duration of said passive mode of operation;

a dwell period between successively transmitted said device function request signals and means for controlling the time duration of each said dwell period; and means for transmitting a said device function request signal containing a passive code having information representing whether or not the said device function request signal is being transmitted during said passive mode of operation.

10. A transmitter as set forth in claim 9 in combination with a device receiver responsive to said device function request signal for controlling performance of said device function, said receiver including means for controlling performance of a said device function in a specific manner when said device function request signal includes a said passive code having information indicating that the said vehicle function request signal is being transmitted during said passive mode of operation.

11. A transmitter as set forth in claim 10 including a portable housing for said transmitter and wherein said housing carries said device function request switch.

12. A transmitter as set forth in claim 11 wherein said housing carries a visual indicator for providing information respecting which mode of operation is in effect.

13. A transmitter as set forth in claim 12 wherein said visual indicator is controlled by said controller to provide a light emitting indication as to which mode of operation is in effect.

14. A transmitter as set forth in claim 13 wherein said visual indicator is controlled by said controller so as to be alternately ON and OFF during said passive mode of operation.

* * * * *